US008910442B2

(12) United States Patent
Lachevrotiere et al.

(10) Patent No.: US 8,910,442 B2
(45) Date of Patent: Dec. 16, 2014

(54) DECK BOARD MOUNTING CLIP

(71) Applicant: Sigma Dek Ltd., Calgary (CA)

(72) Inventors: Stephan Lachevrotiere, Quebec (CA); Francois Parenteau, Quebec (CA); Tory Weber, Calgary (CA); Brian Boettger, Calgary (CA)

( * ) Notice: Subject to any disclaimer, the term of this patent is extended or adjusted under 35 U.S.C. 154(b) by 0 days.

(21) Appl. No.: 13/968,043

(22) Filed: Aug. 15, 2013

(65) Prior Publication Data

US 2014/0165491 A1 Jun. 19, 2014

Related U.S. Application Data

(60) Provisional application No. 61/684,992, filed on Aug. 20, 2012.

(51) Int. Cl.
*E04B 2/30* (2006.01)
*E04B 1/19* (2006.01)
*E04B 1/38* (2006.01)

(52) U.S. Cl.
CPC ..... *E04B 1/1903* (2013.01); *E04B 1/19* (2013.01); *E04B 1/38* (2013.01)
USPC ..... 52/489.1

(58) Field of Classification Search
CPC .... E04F 2201/05; E04F 13/0826; E04B 5/12; E04B 5/02; E04B 5/04
USPC ..... 52/177, 489.1, 489.2, 480, 512, 586.1, 52/586.2, 483.1, 582.1, 650.3, 765, 775; 411/457, 458, 460, 470, 461, 466
See application file for complete search history.

(56) References Cited

U.S. PATENT DOCUMENTS

| | | | | | |
|---|---|---|---|---|---|
| 3,180,460 | A * | 4/1965 | Liskey | 52/479 |
| 3,619,963 | A | 11/1971 | Omholt | |
| 3,932,972 | A * | 1/1976 | Rossman | 52/183 |
| 4,777,778 | A | 10/1988 | Taupin | |
| 5,456,189 | A * | 10/1995 | Belle Isle | 108/57.17 |
| 5,768,850 | A | 6/1998 | Chen | |
| 5,927,035 | A * | 7/1999 | Haytayan | 52/483.1 |
| 6,061,991 | A * | 5/2000 | Dahl | 52/832 |
| 6,062,519 | A * | 5/2000 | Baldassarre | 248/311.2 |
| 6,416,269 | B1 * | 7/2002 | Martel et al. | 411/461 |
| 6,993,875 | B2 * | 2/2006 | Rudduck | 52/474 |
| 7,251,918 | B2 * | 8/2007 | Reif et al. | 52/714 |
| 7,313,893 | B2 * | 1/2008 | Voegele, Jr. | 52/461 |
| 7,398,623 | B2 | 7/2008 | Martel et al. | |
| 7,571,578 | B2 * | 8/2009 | Moody et al. | 52/481.1 |
| 7,600,353 | B2 | 10/2009 | Hafner | |
| 7,805,902 | B2 * | 10/2010 | Martel | 52/489.1 |
| 8,011,153 | B2 | 9/2011 | Orchard | |
| 8,028,491 | B2 * | 10/2011 | Flaherty et al. | 52/747.11 |

(Continued)

*Primary Examiner* — Mark Wendell
*Assistant Examiner* — Keith Minter
(74) *Attorney, Agent, or Firm* — Ryan W. Dupuis; Kyle R. Satterthwaite; Ade & Company Inc.

(57) ABSTRACT

A deck board mounting clip mounts deck boards to joist members with respective undercut portions in a deck structure. The mounting clip has an intermediate body received between an adjacent deck boards, a first retainer flange protruding laterally into the side edge of one of the deck boards, a second retainer flange protruding laterally into the side edge of the next deck board, and a hook portion engageable with the undercut portion of the joist member such that the mounting clip cannot be lifted from the joist member.

20 Claims, 10 Drawing Sheets

(56) References Cited

U.S. PATENT DOCUMENTS

| | | | | |
|---|---|---|---|---|
| 8,146,303 | B2 | 4/2012 | Gibson et al. | |
| 8,393,125 | B2 * | 3/2013 | Martel | 52/489.1 |
| 8,544,229 | B2 * | 10/2013 | Kilgore et al. | 52/489.2 |
| 8,555,570 | B2 * | 10/2013 | Martel | 52/177 |
| 8,667,744 | B2 * | 3/2014 | Shaw | 52/97 |
| 8,739,489 | B2 * | 6/2014 | Weber et al. | 52/510 |
| 8,745,946 | B2 * | 6/2014 | D'Alessandro et al. | 52/506.05 |
| 2004/0079041 | A1 * | 4/2004 | Bergeron et al. | 52/489.1 |
| 2005/0252156 | A1 * | 11/2005 | Martel et al. | 52/714 |
| 2008/0240886 | A1 * | 10/2008 | Martel et al. | 411/458 |
| 2009/0205285 | A1 * | 8/2009 | Jendusa | 52/650.3 |
| 2009/0217495 | A1 * | 9/2009 | Tipps et al. | 24/458 |
| 2009/0272060 | A1 * | 11/2009 | Lucchesi | 52/489.1 |
| 2010/0257808 | A1 * | 10/2010 | Baxter et al. | 52/586.1 |
| 2011/0067335 | A1 * | 3/2011 | Gibson et al. | 52/489.2 |
| 2012/0031017 | A1 * | 2/2012 | Stroyer | 52/157 |
| 2012/0110944 | A1 * | 5/2012 | Hess | 52/582.1 |
| 2014/0096469 | A1 * | 4/2014 | Fountain | 52/650.3 |

* cited by examiner

DECK BOARD MOUNTING CLIP

This application claims the benefit under 35 U.S.C. 119(e) of U.S. provisional application Ser. No. 61/684,992, filed Aug. 20, 2012.

FIELD OF THE INVENTION

The present invention relates to a mounting clip for securing deck boards to joist members in assembly a deck structure, and more particularly relates to a method of assembling the deck structure using the mounting clip.

BACKGROUND

Patio decks are known to be constructed using manufactured deck boards which are generally extruded or moulded of plastics or various composite materials. The deck boards in some instances are formed with a mounting groove extending longitudinally along the full length of both opposing side edges of the board for attachment to corresponding joists using mounting clips.

Examples of mounting clips for manufactured deck boards are disclosed in U.S. Pat. No. 7,600,353 by Hafner, U.S. Pat. No. 7,398,623 by Martel et al. and U.S. Pat. No. 8,011,153 by Orchard. In each instance, the mounting clip is secured to a conventional wooden joist and opposing lateral retainer flanges on each mounting clip are received within the mounting grooves of an adjacent pair of deck boards in a mounted position. The configuration of the mounting clip in each instance requires an awkward manipulation and time consuming installation of a fastener to be fastened through the clip and into the wooden joist in order to secure the clips. Furthermore, the mounting clips are not suited for use with other types of joists, for example extruded metal joists.

U.S. Pat. No. 8,146,303 by Gibson et al. discloses another example of a mounting configuration for manufactured deck boards in which an elongate track having a series of formed fasteners thereon is secured along the full length on the top of a conventional wooden joist. The formed fasteners of each track must be carefully aligned with the corresponding fasteners of tracks on adjacent joists in order to commonly align with deck boards laid across the joists. Once mounted onto the wooden joist however, no adjustment is permitted in the lengthwise direction of the joist so that any slight misalignments are difficult and time consuming to correct. Furthermore the fastening track is not well suited to other types of joists.

Other mounting clips used for flooring are disclosed in U.S. Pat. No. 5,768,850 by Chen, U.S. Pat. No. 3,619,963 by Omholt and U.S. Pat. No. 4,777,778 by Taupin. In each instance the clip is only suited only for use in tongue and groove boards such that the mounting clips are not compatible with conventional manufactured deck boards including mounting group along both opposing side edges of the boards. Furthermore the clips are not suited for use with various types of extruded joists.

SUMMARY OF THE INVENTION

According to one aspect of the invention there is provided a method of assembling a deck structure, the method comprising:

providing a joist member which is elongate in a longitudinal direction and which comprises an undercut portion extending in the longitudinal along a length of the joist member;

providing a plurality of deck boards, each having laterally opposing side edges arranged to span across the joist member parallel and laterally adjacent to one another and transversely to the longitudinal direction of the joist member;

providing a plurality of mounting clips, in which each mounting clip comprises an intermediate body, a first retainer flange protruding from one side of the intermediate body, a second retainer flange protruding from an opposing side of the intermediate body relative to the first retainer flange, and a hook portion; and positioning each mounting clip by:

engaging the hook portion with the undercut portion of the joist member such that the mounting clip cannot be lifted from the joist member; and inserting the intermediate body between an adjacent pair of the deck boards such that the first retainer protrudes laterally into the side edge of one of the deck boards of said adjacent pair and the second retainer flange protrudes laterally into the side edge of the other one of the deck boards of said adjacent pair.

According to a second aspect of the present invention there is provided a mounting clip for use in a deck structure comprising:

a joist member which is elongate in a longitudinal direction and which comprises an undercut portion extending in the longitudinal along a length of the joist member; and a plurality of deck boards having laterally opposing side edges spanning across the joist member parallel and laterally adjacent to one another and transversely to the longitudinal direction of the joist member;

the mounting clip comprising:

an intermediate body arranged to be received between an adjacent pair of the deck boards;

a first retainer flange protruding from one side of the intermediate body so as to be arranged to protrude laterally into the side edge of one of the deck boards of said adjacent pair;

a second retainer flange protruding from an opposing side of the intermediate body relative to the first retainer flange so as to be arranged to protrude laterally into the side edge of the other one of the deck boards of said adjacent pair; and a hook portion arranged to be engaged with the undercut portion of the joist member such that the mounting clip cannot be lifted from the joist member.

By providing a mounting clip including first and second opposed retainer flanges together with a hooking portion, the clip can be quickly attached to an extruded joist having an undercut retainer portion while being engaged into the side edges of two adjacent manufactured deck boards. The hooking function ensures a strong attachment even if fasteners are not used in a quicker more reliable mounting configuration than prior art devices. The clip does also accommodate a fastener if desired for more secure attachment.

When each deck board includes a pair of mounting grooves formed in laterally opposed side edges thereof so as to extend along a length of the deck board, each retainer flange preferably includes an upward oriented free edge arranged to ease insertion of the retainer flange into a corresponding one of the mounting grooves.

Alternatively when the side edges of the deck boards comprise uninterrupted flat surfaces with no mounting grooves, each retainer flange preferably comprises a pointed free end arranged for penetrating into the side edge of a corresponding deck board.

When the undercut portion is located adjacent one side of the joist member, the method may include positioning each mounting clip by engaging the hook portion with the undercut portion at the side of the joist member such that the intermediate body extends across the joist member towards an opposing side of the joist member.

Each mounting clip may further comprise the intermediate body being elongate between opposing first and second ends in which the hook portion is located adjacent the first end of the intermediate body, and the hook portion includes a lower portion extending inwardly towards the second end of the intermediate body.

Each mounting clip may further comprise an auxiliary flange protruding from one side of the intermediate body at one end of the intermediate body opposite from the hook portion. In this instance the method may include positioning each mounting clip such that the auxiliary flange extends along a bottom side of one of the deck boards.

The method may also include engaging the hook portion of each mounting clip with the undercut portion of the joist member by pivoting the intermediate body relative to the joist member from a disengaged position to an engaged position of the mounting clip relative to the joist member and inserting the retainer flanges into the respective side edges of the adjacent pair of deck boards such that the mounting clip is restricted from pivotal movement from the engaged position to the disengaged position.

Each mounting clip is generally pivoted about an axis oriented in the longitudinal direction of the joist member from the disengaged position to the engaged position.

Each mounting clip is preferably positioned such that the hook member is offset in the longitudinal direction of the joist member to one side of the intermediate body.

Each mounting clip may also be fastened to the joist member subsequent to engaging the hook portion of the mounting clip with the undercut portion of the joist member.

When the joist member includes a recessed channel in a top side which extends in the longitudinal direction along the length of the joist member, each mounting clip may also include a depending portion which depends downwardly from the intermediate body. The method preferably includes positioning each mounting clip by inserting the depending portion into the recessed channel in the top side of the joist member subsequent to the hook portion being engaged with the undercut portion of the joist member. The depending portion of each mounting clip may be fastened to the joist member within the recessed channel.

The intermediate body of each mounting clip may comprise a flat plate member and at least one protrusion which protrudes from each side of the flat plate member. In this instance the method may include positioning each mounting clip such that the flat plate member is oriented vertically between the adjacent pair of deck boards and such that the protrusions abut the side edges of the respective ones of the adjacent pair of deck boards.

Preferably the joist member comprises an extruded member defining a pair of undercut retainer portions extending along opposing sides of the joist member adjacent a flat top side of the joist member.

According to a further aspect of the present invention there is provided a deck structure comprising:

at least one joist member which is elongate in a longitudinal direction and which comprises an undercut portion extending in the longitudinal along a length of the joist member;

a plurality of deck boards, each having laterally opposing side edges spanning across said at least one joist member parallel and laterally adjacent to one another and transversely to the longitudinal direction of said at least one joist member; and a plurality of mounting clips, each mounting clip comprising:

an intermediate body arranged to be received between an adjacent pair of the deck boards;

a hook portion engaged under the undercut portion of one joist member such that the mounting clip cannot be lifted from the joist member;

a first retainer flange protruding from one side of the intermediate body so as to protrude laterally into the side edge of one of the deck boards of said adjacent pair; and a second retainer flange protruding from an opposing side of the intermediate body relative to the first retainer flange so as to protrude laterally into the side edge of the other one of the deck boards of said adjacent pair.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
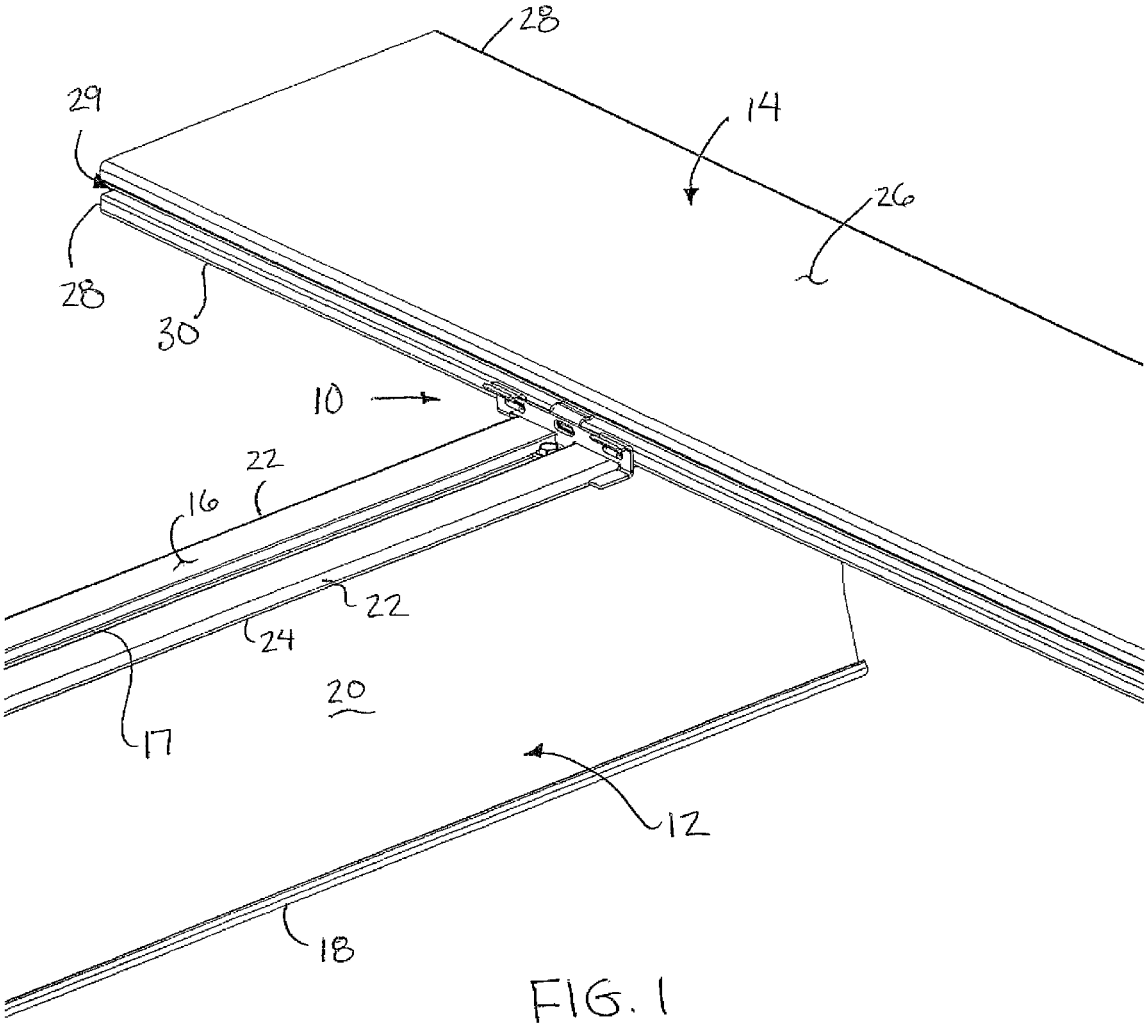
FIG. 1 is a perspective view of the mounting clip according to a first embodiment of the present invention for securing one deck board to a joist member in which the deck board includes longitudinal extending mounting grooves along both side edges.

Referring to the accompanying figures there is illustrated a mounting clip generally indicated by 10. The mounting clip 10 is suited for use in a deck structure comprising a plurality of extruded joist members 12 which are mounted parallel and spaced apart from one another and which are typically mounted at one end to a common ledger board which is not shown. The joist members 12 support a plurality of deck boards 14 to span perpendicularly across the joist members. The mounting clips 10 retain the deck boards 14 secured to the joist members 12.

Although two embodiments of the mounting clips are described and illustrated herein, the features in common to both embodiments will first be described.

The joist members 12 typically comprise an extruded metal member having a hollow core spanning between a flat top 16 and a flat bottom 18 spanning the full length of the member. Two opposing sides 20 span between the top and bottom sides at opposing sides of the joists. The two sides 20 taper downwardly and inwardly from the full width at the top to the narrowest width at a central location between the top and bottom ends. The side walls then taper downwardly and outwardly to increase in lateral width therebetween towards the flat bottom where the sides are similar in width as the top. The top and bottom sides of the joists are generally symmetrical about a horizontal plane extending centrally through the joists. At a top, the opposing side edges 22 protrude laterally outwardly beyond the sides 20 of the joists and depend downwardly at the outer free edges 24 thereof to define a hook shaped undercut portion which extends in the longitudinal direction of the joist member the full length thereof. The flat top includes a central channel 17 which is laterally centered between the side edges and which is recessed downwardly into the joist member to a flat bottom surface of the channel which spans the full length of the joist member in the longitudinal direction.

The deck boards 14 each comprise a manufactured member which is extruded or molded of a plastic or composite material. Each board includes a flat top 26 spanning a full length of the deck board in the longitudinal direction. Two opposing side edges 28 span longitudinally along opposing sides of the deck boards so as to be generally flat and upright and parallel to one another. The bottom 30 of each deck board is also generally flat for mounting directly against the top side of the joist members across which it spans.

Each mounting clip 10 mounts between an adjacent pair of the deck boards to retain corresponding side edges with which is abutted secured to the respective joist member.

Each clip 10 includes an intermediate body 32 in the form of a generally flat plate member which is elongate in a longitudinal direction of the clip extending between a first end 34 and a second end 36 opposite from the first end. The intermediate body is arranged to be mounted in a generally vertical orientation in the gap between the adjacent deck boards with which it is associated so as to extend in a longitudinal direction of the deck boards while being generally perpendicular to the longitudinal direction of the corresponding joist member. Length of the clip between the opposing first and second ends is arranged to be greater than the lateral width of the top side of the joist member so that the intermediate body fully expands across and beyond the full width of the flat top of the joist member. The height of the plate member defining the body 32 corresponds approximately to the thickness of the deck boards between the flat bottom and a centrally located mounting groove in the deck board when the deck board includes mounting grooves formed along opposing side edges thereof.

Protrusions are formed in the flat plate member of the intermediate body to define a thickness of the body which controls the width of the gap between adjacent deck boards. The protrusions include a central protrusion 38 centrally located between opposing ends of the body in the longitudinal direction of the body and oriented to protrude from a first side 40 of the body. The protrusions on the flat plate member also include two outer protrusions 42 which are located in the body adjacent the opposing first and second ends thereof to protrude from the plane of the body 32 in a common outward direction from the second side 44 opposite the central protrusion 38 protruding from the first side 40. The central protrusion 38 is arranged to abut the side edge of a first one of the deck boards while the two outer protrusions 42 abut the side edge of the second deck board such that the combined lateral dimension of the protrusions fully span and define the width of the gap between the adjacent deck boards.

Each clip further includes a hook portion 46 at the first end 34 of the body. The hook portion includes a flange portion 48 extending horizontally outward from the first side 40 of the plate member in perpendicular relation thereto. The flange portion protrudes from the bottom side of the body so as to be suitably located to extend along a bottom side of the first adjacent deck board at a location offset laterally outwardly in relation to the joist member across which the body of the clip spans. The flange portion only protrudes from the first side of the intermediate body so as to be offset in the longitudinal direction of the joist member fully to one side of the body of the mounting clip in the mounted position.

The hook portion further includes a lower portion 50 extending inwardly from the flange portion 48 in the longitudinal direction towards the other second end 36 of the intermediate body. The lower portion 50 extends inwardly from the flange portion initially at a downward inclination to a lower apex such that the remaining portion extends upwardly as it continues inwardly towards the opposing second end of the body. The lower portion 50 of the hook portion thus defines the hook shape which is arranged to be hooked and retained beneath the undercut area along one side edge of the joist member.

The hook portion is mated with the undercut portion by initially positioning the longitudinal direction of the mounting clip to extend generally upward from the first end 34 to the second end 36 which permits lateral insertion of the hook portion below the undercut area. The mounting clip is then generally rotated about an axis oriented parallel to the longitudinal axis of the joist member until the longitudinal direction of the mounting clip between the first end 34 and a second end 36 assumes a generally horizontal orientation spanning across the top side of the joist member. The clip is generally rotated from a disengaged position to an engaged position. In the disengaged position the longitudinal direction of the intermediate body is in an upright orientation to permit ready release of the hook portion in a downward and lateral direction from the undercut portion of the joist. In the engaged position the depending end portion of the outer edge 24 of the joist member extends downward into the apex of the lower portion of the hook portion 46 such that the body of the mounting clip is restricted from being displaced relative to the joist member in all directions other than sliding in the longitudinal direction of the joist or being generally rotated in the direction towards the disengaged position. Accordingly in the engaged position the mounting clip is prevented from lifting upwardly relative to the joist member while similarly being prevented from being displaced in a lateral direction relative to the joist member corresponding to a longitudinal direction of the deck boards. The extruded and continuous cross sectional shape of the joist member however permits sliding of the mounting clip in the longitudinal direction of the joist member to permit abutment and engagement of the mounting clip with a deck board already placed on the joist member subsequent to the hook portion being rotated into the engaged position relative to the undercut portion of the joist member.

To further secure the mounting clip in place, a fastener 52 may optionally be used for securing the mounting clip to the joist member. To accommodate the fastener 52 the mounting clip 10 includes a depending portion which is centrally located between the opposing ends of the body 32 for alignment with the central channel 17 centrally located in the top side of the joist member. The depending portion includes a first flange 54 extending downwardly within the plane of the intermediate body 32 and a second flange 56 at the bottom of the first flange which extends horizontally outward to protrude outwardly from the second side of the mounting body in an opposing direction from the hook portion 46. The second flange 56 is spaced below the bottom of the intermediate body 32 by a height corresponding to the depth of the central channel 17 from the top side of joist member such that the second flange is arranged to abut the flat bottom of the central channel. A fastener aperture 58 is located in the second flange 56 to receive the fastener therethrough. The fastener 52 typically comprises a self tapping metal screw arranged to be penetrated into the channel at the top side of the joist member at any position along the length thereof.

The clip 10 further includes an auxiliary flange 60 adjacent the second end of the body 32. The auxiliary flange 60 is in a common plane with the flange portion 48 of the hook portion but protrudes laterally outwardly in an opposing second direction relative to the hook portion such that the auxiliary flange 60 is arranged to extend along the bottom side of a second deck board in the mounted position. The auxiliary flange 60 is spaced apart from the flange portion of the hook portion 46 by a distance which is greater than the overall width of the topside of the joist member. Accordingly the auxiliary flange 60 and the flange portion 48 of the hook portion engage under the bottom side of corresponding ones of the deck boards at respective locations spaced outward from opposing sides of the joist member so as not to interfere with direct abutment of the deck boards with the joist members.

To retain the deck boards to the joist member, the clip further comprises a first retainer flange 62 and a pair of second retainer flanges 64. The first retainer flange 62 is centered in the longitudinal direction of the body 32 of the clip between the opposing ends thereof so as to be aligned with the depending portion 54 of the clip. The first retainer flange 62 protrudes laterally outwardly from the first side of the intermediate body 32 adjacent the top side of the body so as to be suitably aligned for extending into the side edge of the deck board.

The two second retainer flanges 64 are located at the opposing ends of the body respectively and are arranged to both project laterally outwardly from the second side of the body 32 opposite the first flange protruding from the first side. The second flanges 64 are similarly located adjacent the top side of the body for protruding laterally outwardly and extending into the corresponding side edge of the second deck board with which the mounting clip is abutted.

The retainer flanges protrude laterally outwardly farther than the protrusions 38 and 42 so as to protrude into the deck boards while the protrusions are abutted between the side edges of the adjacent deck boards.

Figure 2:
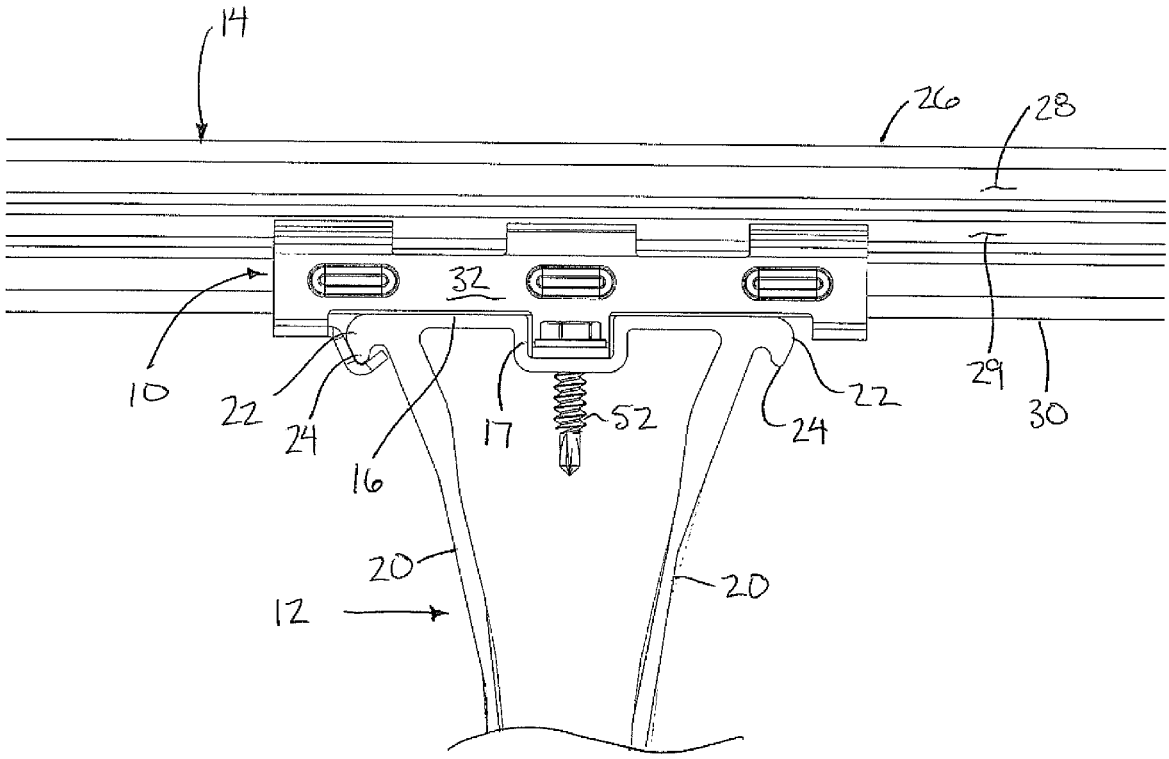
FIG. 2 is an end elevational view of an upper portion of a joist member supporting a mounting clip engaged with one deck board thereon according to the first embodiment.
Figure 3:
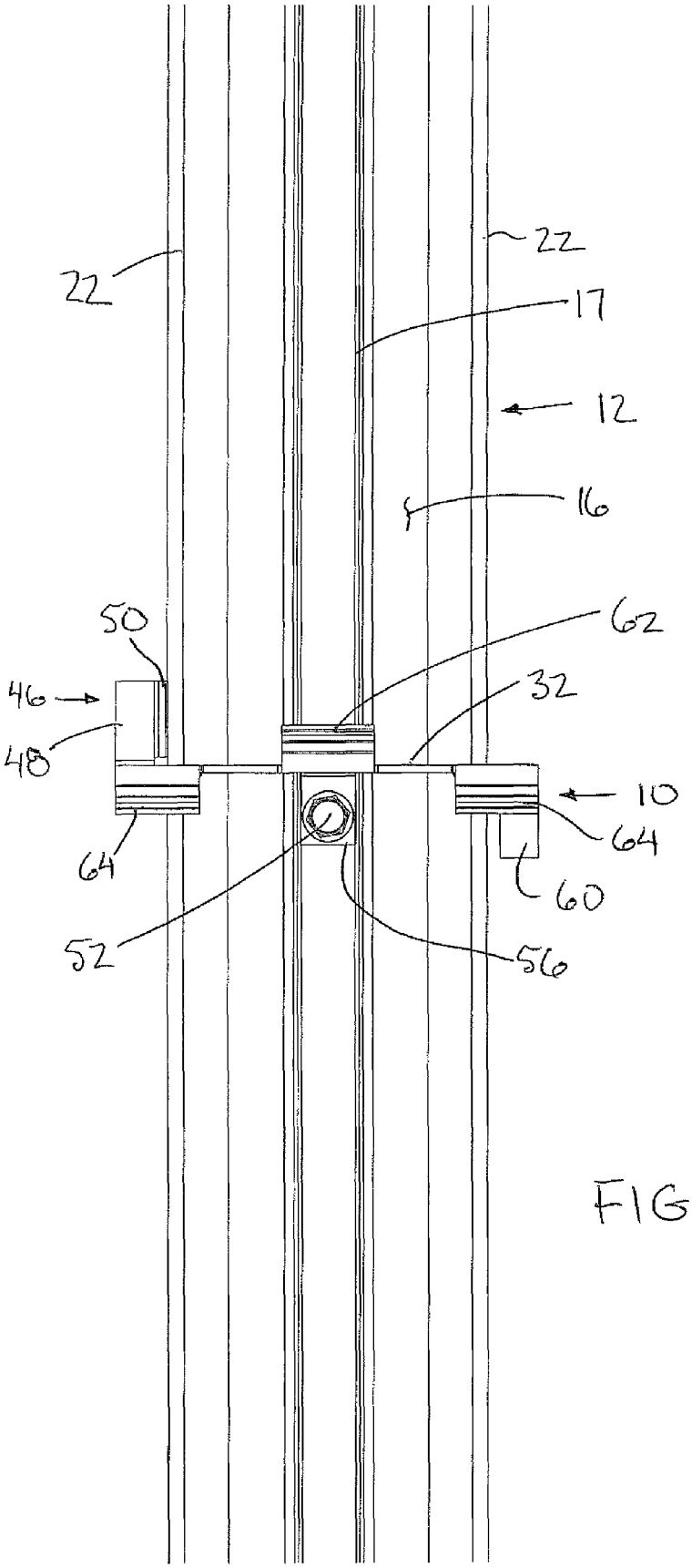
FIG. 3 is a top plan view of a mounting clip mounted onto the top side of a joist member according to the first embodiment.
Figure 4:
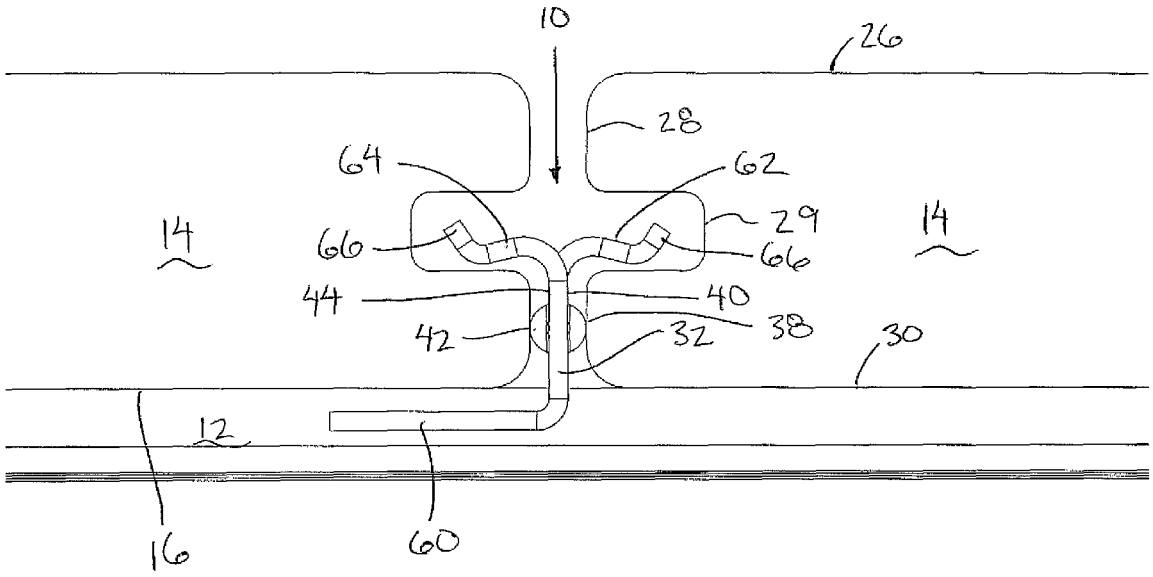
FIG. 4 is an end elevational view of two adjacent deck boards retained on a joist member by a mounting clip according to the first embodiment.
Figure 5:
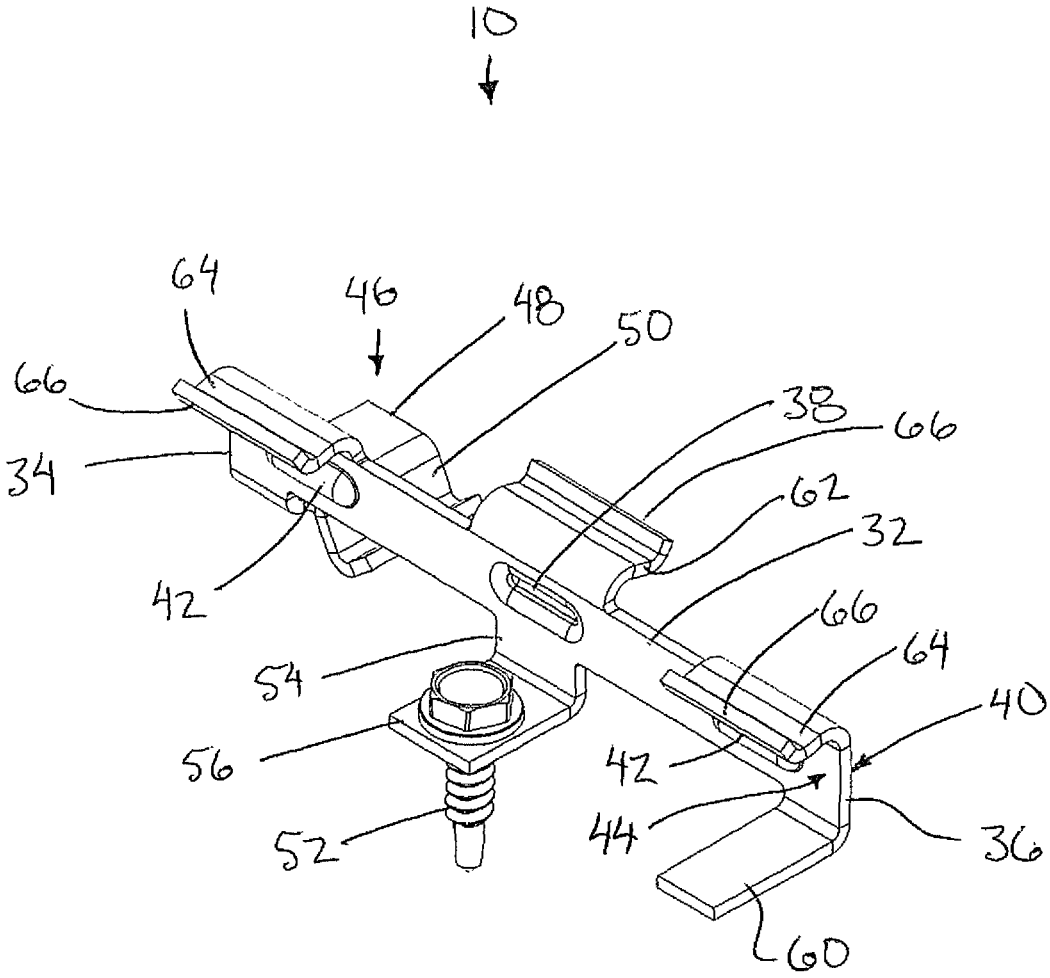
FIG. 5 is a perspective view of the mounting clip of FIG. 1.
Figure 6:
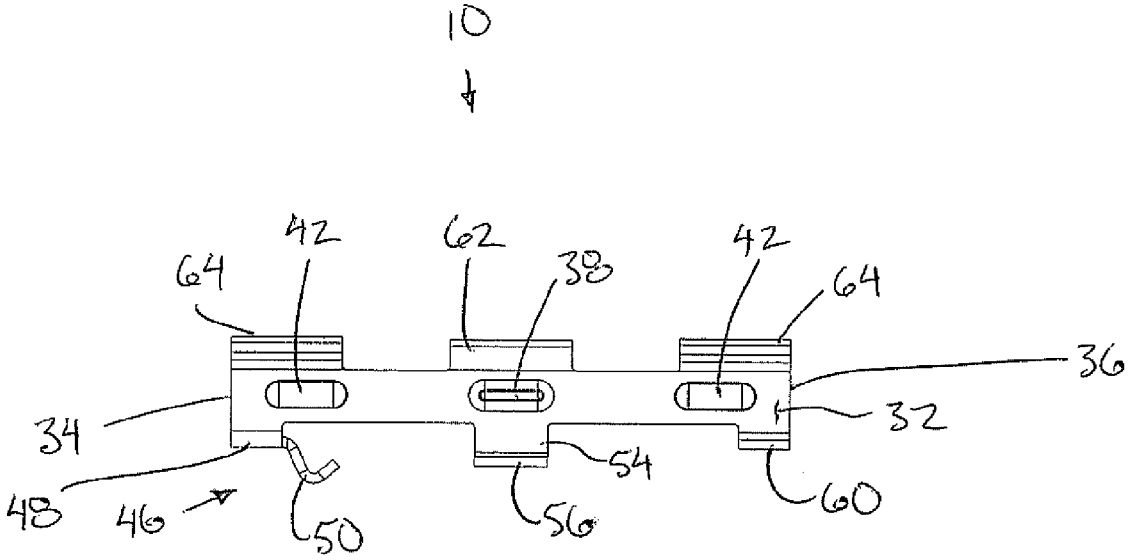
FIG. 6 is a side elevational view of the mounting clip of FIG. 1.
Figure 7:
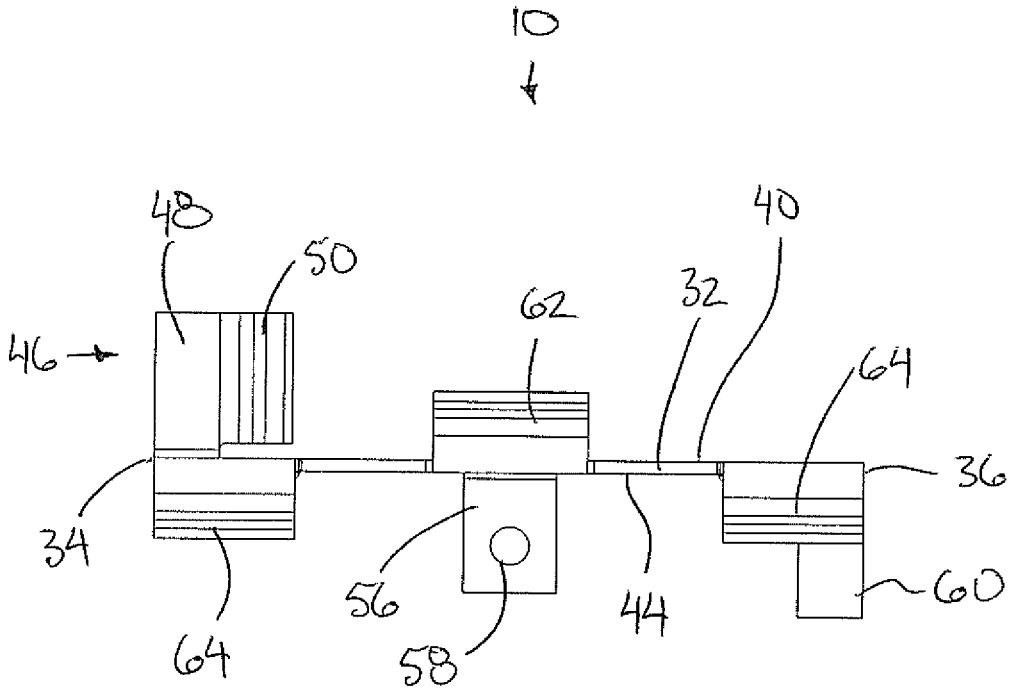
FIG. 7 is a top plan view of the mounting clip of FIG. 1.
Figure 8:
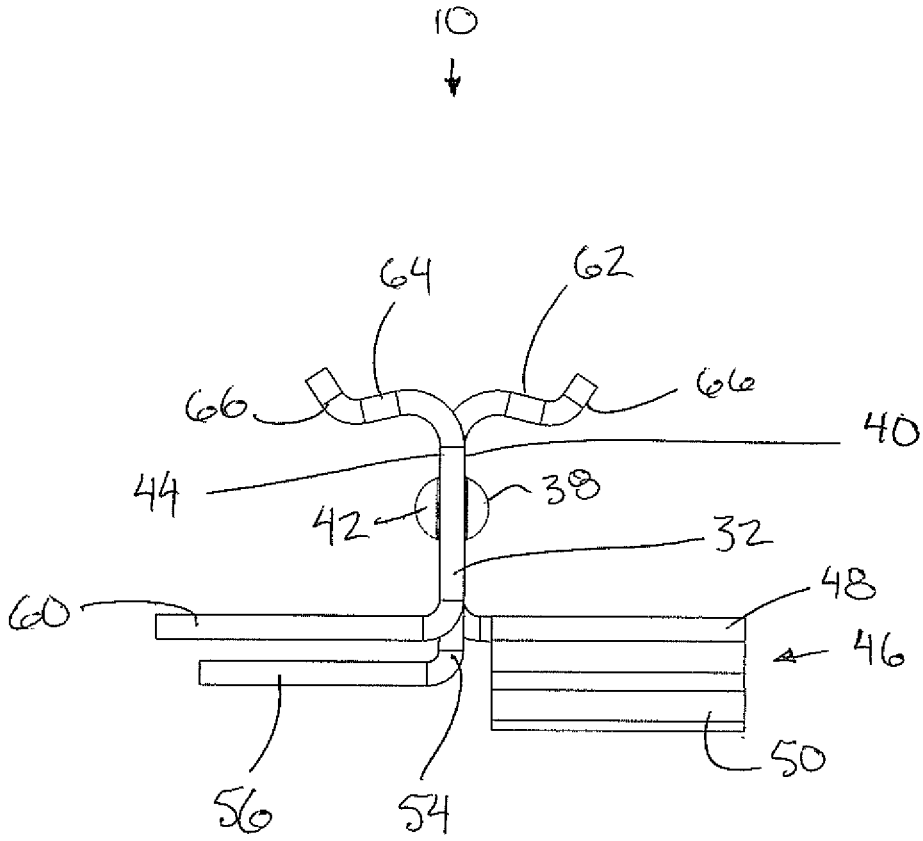
FIG. 8 is an end elevational view of the mounting clip of FIG. 1.

Turning now more particularly to the embodiment of FIG. 1 through 8, in some instances, a mounting groove 29 is located within each side edge 28 at a central location between the top and bottom sides of the deck board. Each groove comprises a generally U shaped recess in cross section extending laterally inwardly from an opening at the side of the deck board. In this instance the first retainer flange 62 protrudes laterally outwardly from the first side of the intermediate body 32 adjacent the top side of the body so as to be suitably aligned with the mounting groove of the first deck board. The free edge 66 of the flange curves upwardly and outwardly for ease of insertion of the flange into the mounting groove of the deck board. The second flanges 64 are similarly located adjacent the top side of the body for protruding outwardly and into the corresponding mounting groove along the side edge of the second deck board with which the mounting clip is abutted. The free edges 66 of the second flanges 64 are similarly curved upwardly and outwardly for ease of insertion into the corresponding mounting groove.

Figure 9:
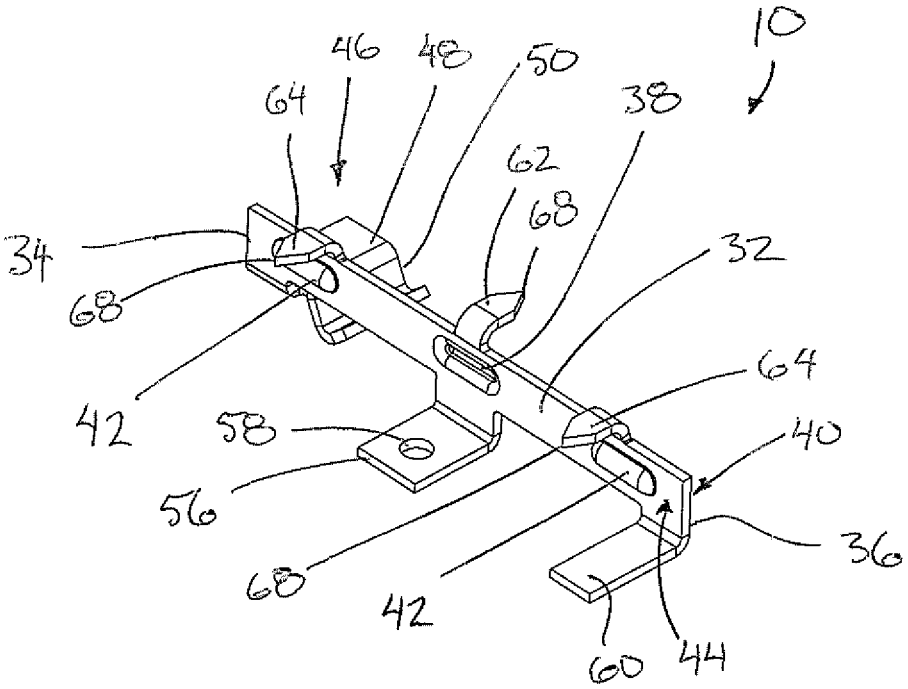
FIG. 9 is a perspective view of a second embodiment of the mounting clip for use with deck boards having flat side edges.
Figure 10:
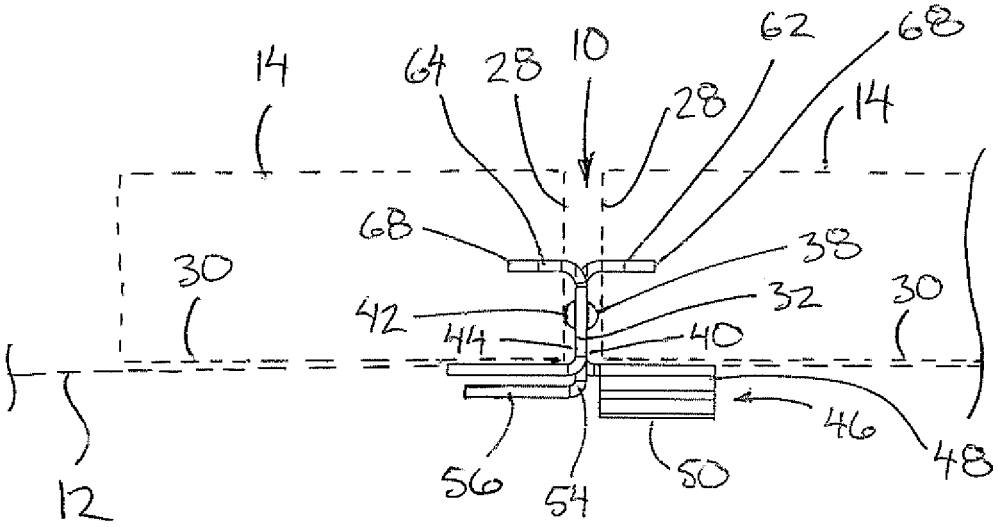
FIG. 10 is an end elevational view of the mounting clip according to the second embodiment shown supporting a pair of deck boards on a joist member.
Figure 11:
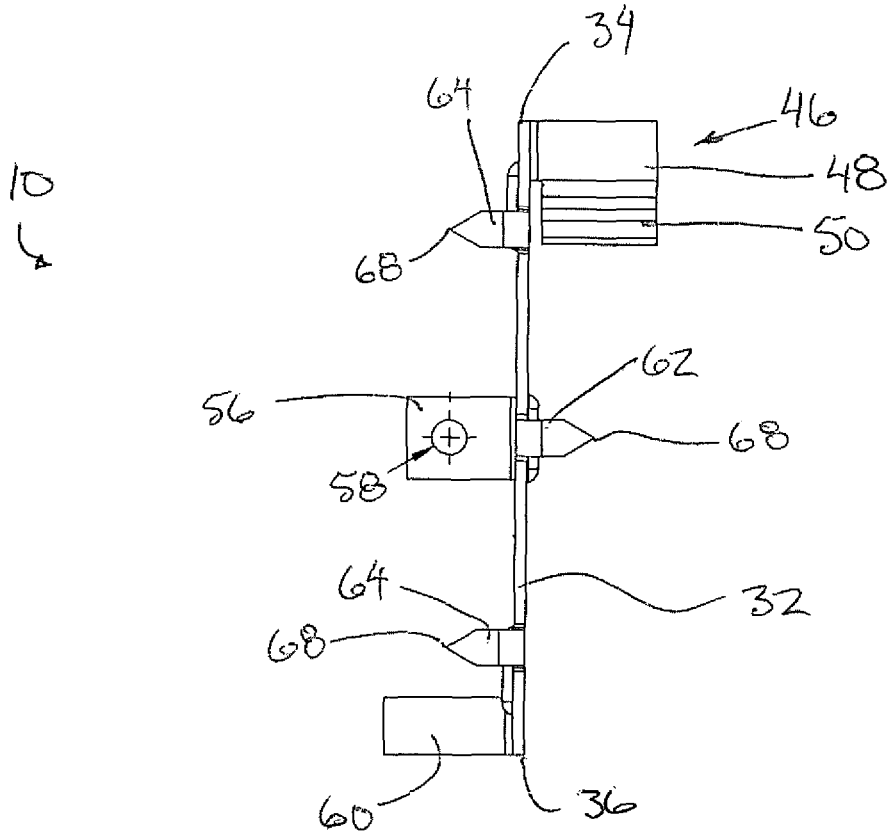
FIG. 11 is a top plan view of the mounting clip of FIG. 9.
Figure 12:
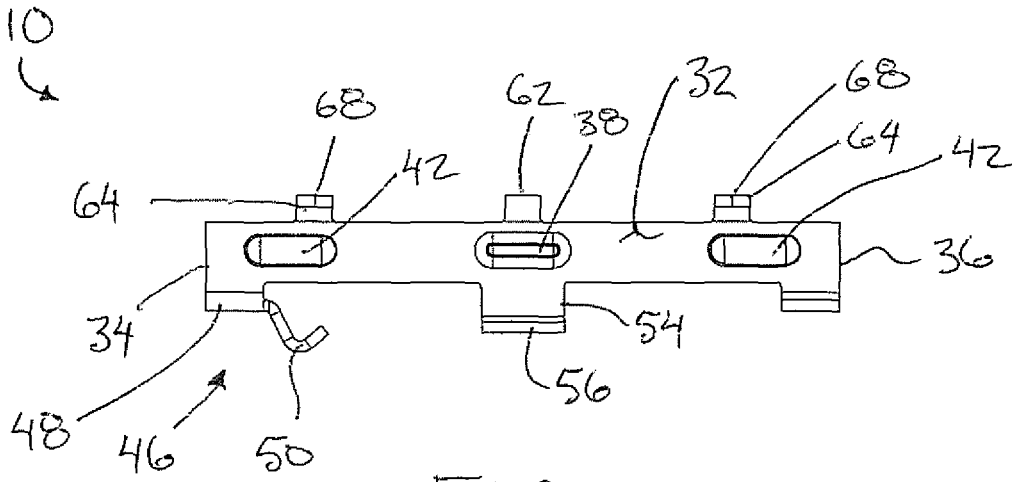
FIG. 12 is a side elevational view of the mounting clip of FIG. 9.

Turning now more particularly to the second embodiment shown in FIG. 9 through 12, the mounting clip in this instance is suited for use with deck boards having no mounting grooves in the opposing flat side edges. In this instance the retainer flanges flat and provided with pointed tips 68 rather than the curved free edges 66 of the previous embodiment such that the flanges are suited for penetrating into the body of the deck board.

In use a first deck board is initially positioned across the joist members and secured at the outer edge in a suitable manner. Mounting clips are then attached to each of the joist members adjacent the inner side of the deck board by mating the hook portions with the undercut portion of the respective joist members by rotating each clip from the disengaged to the engaged position as described above. The mounting clips are then slidably displaced along the joist members in the longitudinal direction of the joist members into engagement with the first deck board by inserting the first retainer flange into the side edge of the first deck board until the corresponding protrusion abuts the side edge of the deck board.

The insertion of the first retainer flange into the side edge of the deck board may involve the mating of the retainer flange with the mounting groove of the deck board according to the first embodiment or penetration of the retainer flange into the side edge of the deck board according to the second embodiment. In either instance the insertion of the first retainer flange into the side edge of the second deck board is sufficient to resist rotation of the mounting clip into the disengaged position. Use of a fastener screw 52 however further ensures that the mounting clip cannot be released from the joist member or the deck board.

When all of the mounting clips have been secured to the respective joist members and mated with the first deck board, a second deck board is placed across the joist members and is slidably displaced in the longitudinal direction of the joist members towards the first deck board until all of the second retainer flanges are suitably inserted into the corresponding side edge of the second deck board and until the side edge of the deck board is abutted with the corresponding protrusions in the intermediate body. Again, the insertion of the second retainer flanges into the side edge of the second deck board can be accomplished according to the mounting clip of the first or second embodiments depending upon the configuration of the deck board.

An additional set of mounting clips can then be used to secure the other side edge of the second deck board to permit subsequent deck board and mounting clips to be attached to the joists in a similar manner.

In further embodiments, the mounting clips may span laterally across only half of the width of a corresponding joist member so as to span from the hook portion engaged upon one undercut side edge of the joist member to an opposing end received in the central channel 17 without the remaining portion of the clip being required. This configuration of clip is particularly suited for mounting to joists forming a perimeter edge of the assembled deck structure.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of assembling a deck structure, the method comprising:

providing a joist member which is elongate in a longitudinal direction and which comprises an undercut portion extending in the longitudinal along a length of the joist member;

providing a plurality of deck boards, each having laterally opposing side edges arranged to span across the joist member parallel and laterally adjacent to one another and transversely to the longitudinal direction of the joist member;

providing a plurality of mounting clips, in which each mounting clip comprises an intermediate body, a first retainer flange protruding from one side of the intermediate body, a second retainer flange protruding from an opposing side of the intermediate body relative to the first retainer flange, and a hook portion; and positioning each mounting clip by:

engaging the hook portion with the undercut portion of the joist member such that the mounting clip cannot be lifted from the joist member by pivoting the intermediate body relative to the joist member from a disengaged position to an engaged position of the mounting clip relative to the joist member; and inserting the intermediate body between an adjacent pair of the deck boards such that: i) the first retainer flange protrudes laterally into the side edge of one of the deck boards of said adjacent pair, ii) the second retainer flange protrudes laterally into the side edge of the other one of the deck boards of said adjacent pair, and iii) the mounting clip is restricted from pivotal movement from the engaged position to the disengaged position by the engagement of the retainer flanges with the deck boards.

2. The method according to claim 1 wherein the undercut portion is located adjacent one side of the joist member, and wherein the method includes positioning each mounting clip by engaging the hook portion with the undercut portion at the side of the joist member such that the intermediate body extends across the joist member towards an opposing side of the joist member.

3. The method according to claim 1 wherein each mounting clip further comprises the intermediate body being elongate between opposing first and second ends, the hook portion being located adjacent the first end of the intermediate body, and the hook portion including a lower portion extending inwardly towards the second end of the intermediate body.

4. The method according to claim 1 wherein each mounting clip further comprises an auxiliary flange protruding from one side of the intermediate body at one end of the intermediate body opposite from the hook portion and wherein the method includes positioning each mounting clip such that the auxiliary flange extends along a bottom side of one of the deck boards.

5. The method according to claim 1 including hooking each mounting clip relative to the joist member along only one side of the joist member.

6. The method according to claim 1 including pivoting each mounting clip about an axis oriented in the longitudinal direction of the joist member from the disengaged position to the engaged position.

7. The method according to claim 1 including positioning each mounting clip such that the hook member is offset in the longitudinal direction of the joist member to one side of the intermediate body.

8. The method according to claim 1 including fastening each mounting clip to the joist member subsequent to engaging the hook portion of the mounting clip with the undercut portion of the joist member.

9. The method according to claim 1 wherein the joist member includes a recessed channel in a top side which extends in the longitudinal direction along the length of the joist member, wherein each mounting clip includes a depending portion which depends downwardly from the intermediate body, and wherein the method includes positioning each mounting clip by inserting the depending portion into the recessed channel in the top side of the joist member subsequent to the hook portion being engaged with the undercut portion of the joist member.

10. The method according to claim 9 including fastening the depending portion of each mounting clip to the joist member within the recessed channel.

11. The method according to claim 1 wherein the intermediate body of each mounting clip comprises a flat plate member and at least one protrusion which protrudes from each side of the flat plate member, and wherein the method includes positioning each mounting clip such that the flat plate member is oriented vertically between the adjacent pair of deck boards and such that the protrusions abut the side edges of the respective ones of the adjacent pair of deck boards.

12. The method according to claim 1 wherein the joist member comprises an extruded member defining a pair of undercut retainer portions extending along opposing sides of the joist member adjacent a flat top side of the joist member.

13. A mounting clip for use in a deck structure comprising:

a joist member which is elongate in a longitudinal direction and which comprises an undercut portion extending in the longitudinal along a length of the joist member; and a plurality of deck boards having laterally opposing side edges spanning across the joist member parallel and laterally adjacent to one another and transversely to the longitudinal direction of the joist member;

the mounting clip comprising:

an intermediate body arranged to be received between an adjacent pair of the deck boards;

a first retainer flange protruding from one side of the intermediate body so as to be arranged to protrude laterally into the side edge of one of the deck boards of said adjacent pair;

a second retainer flange protruding from an opposing side of the intermediate body relative to the first retainer flange so as to be arranged to protrude laterally into the side edge of the other one of the deck boards of said adjacent pair;

a hook portion arranged to be engaged with the undercut portion of the joist member such that the mounting clip cannot be lifted from the joist member; and an auxiliary flange protruding from one side of the intermediate body at one end of the intermediate body opposite from the hook portion so as to be arranged to extend along a bottom side of one of the deck boards opposite the hook portion.

14. The mounting clip according to claim 13 further comprising the intermediate body being elongate between opposing first and second ends so as to be arranged to span across a width of the joist member between the first and second ends, the hook portion being located adjacent the first end of the intermediate body, and the hook portion including a lower portion extending inwardly towards the second end of the intermediate body so as to be arranged to be retained beneath the undercut portion of the joist member.

15. The mounting clip according claim 13 wherein the hook portion of each mounting clip is arranged to be engaged with the undercut portion of the joist member only by pivoting the intermediate body relative to the joist member from a disengaged position to an engaged position of the mounting clip and wherein insertion of the retainer flanges into the respective side edges of the adjacent pair of deck boards is arranged to restrict pivotal movement of the intermediate body from the engaged position to the disengaged position.

16. The mounting clip according to claim 13 wherein each mounting clip further comprises a depending portion which depends downwardly form the intermediate body and which includes a fastener aperture therein so as to be arranged to be fastened to the joist member subsequent to engaging the hook portion of the mounting clip with the undercut portion of the joist member.

17. The mounting clip according to claim 13 for use with a joist member which includes a recessed channel in a top side which extends in the longitudinal direction along the length of the joist member, wherein each mounting clip further comprises a depending portion which depends downwardly from the intermediate body so as to be arranged for insertion into the recessed channel in the top side of the joist member.

18. The mounting clip according to claim 13 wherein the intermediate body of each mounting clip comprises a flat plate member and at least one protrusion which protrudes from each side of the flat plate member such that the flat plate member is arranged to be oriented vertically between the adjacent pair of deck boards with the protrusions in abutment with the side edges of the respective ones of the adjacent pair of deck boards.

19. A deck structure comprising:

at least one joist member which is elongate in a longitudinal direction and which comprises an undercut portion extending in the longitudinal along a length of the joist member;

a plurality of deck boards, each having laterally opposing side edges spanning across said at least one joist member parallel and laterally adjacent to one another and transversely to the longitudinal direction of said at least one joist member; and a plurality of mounting clips, each mounting clip comprising:

an intermediate body arranged to be received between an adjacent pair of the deck boards;

a hook portion engaged under the undercut portion of one joist member such that the mounting clip cannot be lifted from the joist member;

a first retainer flange protruding from one side of the intermediate body so as to protrude laterally into the side edge of one of the deck boards of said adjacent pair;

a second retainer flange protruding from an opposing side of the intermediate body relative to the first retainer flange so as to protrude laterally into the side edge of the other one of the deck boards of said adjacent pair; and a depending portion which depends downwardly from the intermediate body and which is fastened to said one joist member at a location which is recessed relative to a top side of the joist member.

20. The deck structure according to claim 19 wherein said at least one joist member includes a recessed channel in a top side which extends in the longitudinal direction along the length of the joist member and which is arranged to receive the depending portion of a respective one of the mounting clips fastened therein.

* * * * *